US005209683A

United States Patent [19]

Imaeda et al.

[11] Patent Number: 5,209,683

[45] Date of Patent: May 11, 1993

[54] REMOVABLE JET PROPULSION UNIT FOR WATERCRAFT

[75] Inventors: Hirofumi Imaeda; Yoshiki Futaki, both of Iwata, Japan

[73] Assignee: Yamaha Hatsoduki Kabushiki Kaisha, Iwata, Japan

[21] Appl. No.: 731,538

[22] Filed: Jul. 17, 1991

[30] Foreign Application Priority Data

Jul. 17, 1990 [JP] Japan ..... 2-189174

[51] Int. Cl.[5] ..... B63H 11/00

[52] U.S. Cl. ..... 440/38

[58] Field of Search ..... 440/38, 39, 40, 41, 440/42, 43, 61, 63

[56] References Cited

U.S. PATENT DOCUMENTS 3,116,710 1/1964 Cass ..... 440/61
4,325,699 4/1982 Castoldi ..... 440/47

FOREIGN PATENT DOCUMENTS 386760 9/1990 European Pat. Off. ..... 440/40
2732671 2/1979 Fed. Rep. of Germany ..... 440/38

*Primary Examiner*—Jesus D. Sotelo
*Assistant Examiner*—Stephen P. Avila
*Attorney, Agent, or Firm*—Ernest A. Beutler

[57] ABSTRACT

A jet propelled boat having a tunnel at its rear end in which a jet propulsion unit is movably supported. The support for the jet propulsion unit is readily detachable so that the jet propulsion unit may be easily removed from the tunnel. The tunnel is closed at its rear end by a transom of the boat in which a small opening is formed through which the jet propulsion unit may be removed.

13 Claims, 5 Drawing Sheets

REMOVABLE JET PROPULSION UNIT FOR WATERCRAFT

BACKGROUND OF THE INVENTION

This invention relates to a removable jet propulsion unit for a watercraft and more particularly to an improved watercraft construction having a removable jet propulsion unit.

The advantages of jet propelled watercraft are well known. If the watercraft is powered by a jet propulsion unit that is mounted within a tunnel positioned at the rear end of the hull of the watercraft, the overall configuration of the watercraft can be quite smooth and sleek. However, when the jet propulsion unit is mounted in such a tunnel, certain difficulties arise. Specifically, the jet propulsion unit tends to be submerged at all times, even when the watercraft is not being operated, and barnacles and other incrustation can form on the water inlet portion of the unit.

There have been proposed, therefore, arrangements wherein the jet propulsion unit is movable between a normal position within the tunnel and a raised position in which the water inlet opening is disposed out of the body of water in which the watercraft is operating. This avoids these disadvantages. In addition, arrangements have been provided wherein the water inlet opening may be rotated to an upwardly facing position so as to permit foreign material to be cleaned from the water inlet portion of the jet propulsion unit.

In watercraft embodying such movable jet propulsion units, it has been the practice to have the tunnel extend completely through the rear of the hull of the watercraft and thus, a relatively large opening is formed at the rear of the watercraft. This large opening is somewhat further enlarged so as to permit access to the jet propulsion unit even when it is in its raised out of the water position. As a result, the hull of the watercraft may be weakened to some extent.

The provision of the large rear opening for the tunnel has also been employed so as to facilitate removal and servicing of the jet propulsion unit from the tunnel. In this way, the jet propulsion unit can be removed from the hull even when the watercraft is in the body of water. However, the disadvantages of this type of construction have been already noted.

It is, therefore, a principal object of this invention to provide an improved hull construction for a jet propelled watercraft.

It is a further object of this invention to provide a jet propelled watercraft of the type wherein the jet propulsion unit may be movable within the tunnel and can be easily removed.

It is a further object of this invention to provide a removable arrangement for the jet propulsion unit of a watercraft and wherein the removal is facilitated through a small opening in the transom of the watercraft so as to permit a high strength hull design.

SUMMARY OF THE INVENTION

This invention is adapted to be embodied in a jet propelled watercraft having a hull with a tunnel formed in the rear portion thereof. A jet propulsion unit is mounted within the tunnel and is operative to propel the watercraft through the body of water in which it is operating. In accordance with the invention, the rear end of the tunnel is closed by an integral wall of the hull which has a small opening at the lower end thereof through which the jet propulsion unit may be removed.

In accordance with another feature of the invention, the jet propulsion unit is readily detachable from the hull for removal through the aforenoted small opening.

DETAILED DESCRIPTION OF THE PREFERRED EMBODIMENT OF THE INVENTION

Figure 1:
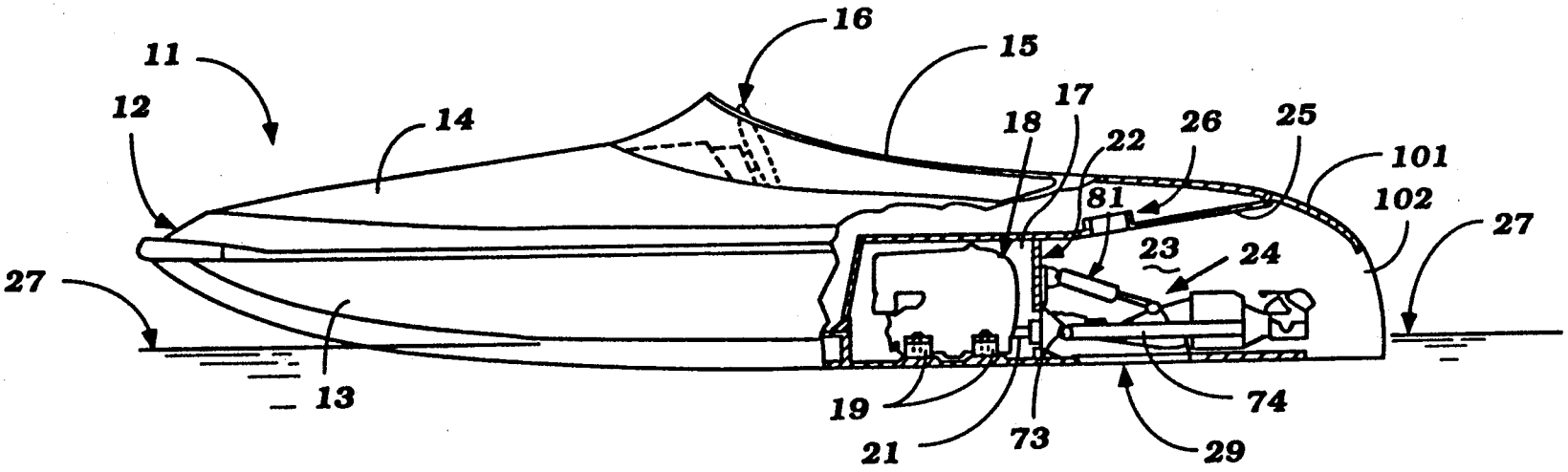
FIG. 1 is a side elevational view of a watercraft powered by a jet propulsion unit constructed in accordance with an embodiment of the invention, with a portion broken away so as to more clearly show certain details of the construction.

Referring first in detail to FIG. 1, a watercraft having a jet propulsion unit constructed and mounted in accordance with an embodiment of the invention is identified generally by the reference numeral 11. The watercraft 11 has a hull, indicated generally by the reference numeral 12 which may have any suitable configuration and which may be comprised of a lower hull portion 13 and a deck portion 14 with these portions being formed from suitable material such as a molded fiberglass reinforced resin. In the illustrated embodiment, the hull 12 is provided with a rearwardly positioned passenger compartment 15 in which a steering wheel 16 and other controls are provided for operating the watercraft 11.

The central rear portion of the lower part of the hull 13 is formed with an engine compartment 17 in which an internal combustion 18 of any known type is mounted on engine supports 19. The engine 18 has its output shaft 21 extending rearwardly through a bulkhead 22 formed forwardly of a tunnel 23 that extends generally along the longitudinal axis of the watercraft and in which a jet propulsion unit, indicated generally be reference numeral 24 is positioned. The tunnel 23 is defined in part by a horizontally extending surface 25 of the hull 12 in which an access opening 26 is provided for a purpose to be described. The watercraft 11 is designed to be operated in a body of water at a normal water level as shown by the line 27 in the certain of the figures.

Figure 2:
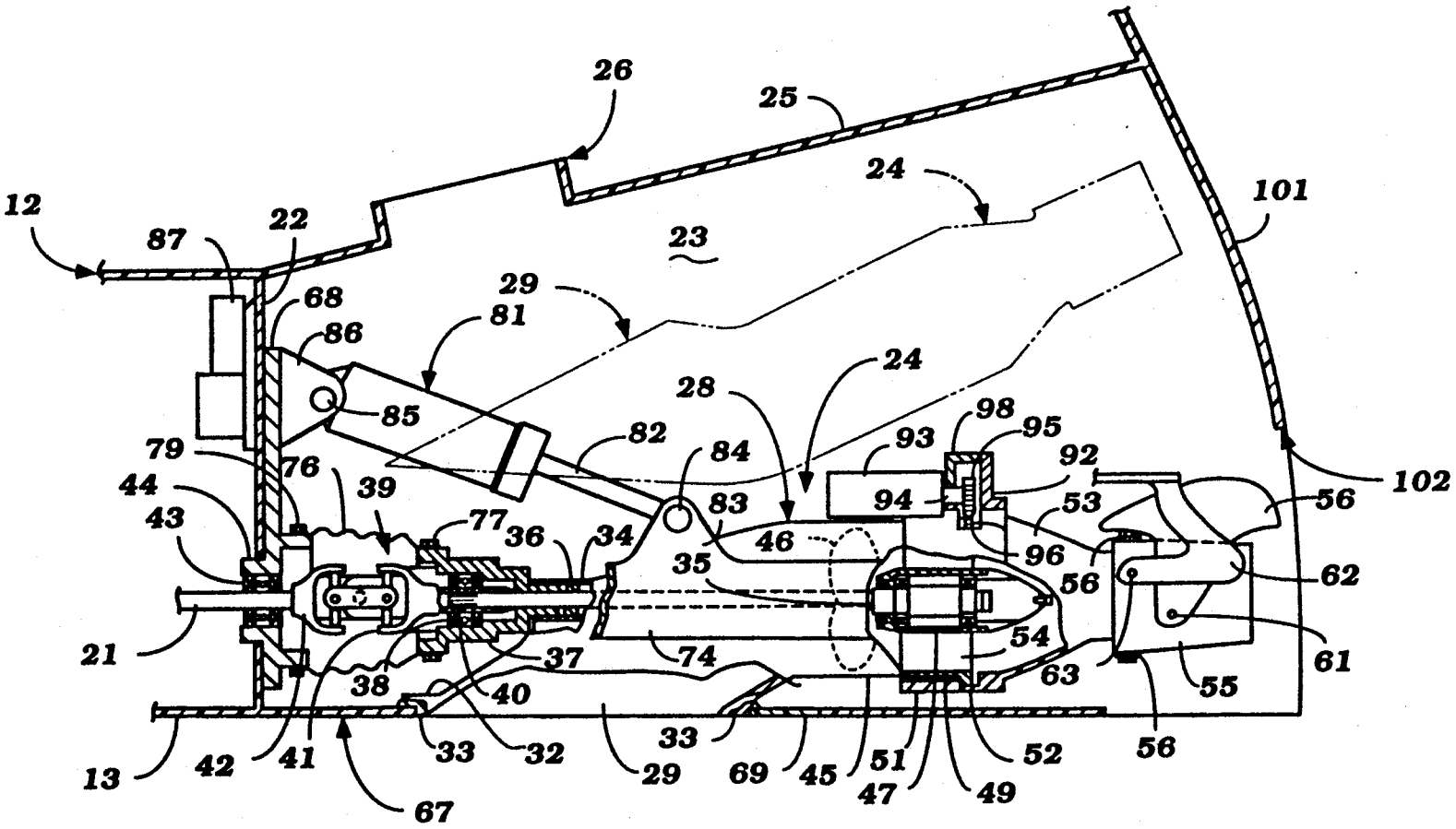
FIG. 2 is an enlarged cross sectional view of the broken away portion of FIG. 1 showing the propulsion unit in its normal position in solid lines and in its out of the water servicing position in phantom lines.
Figure 3:
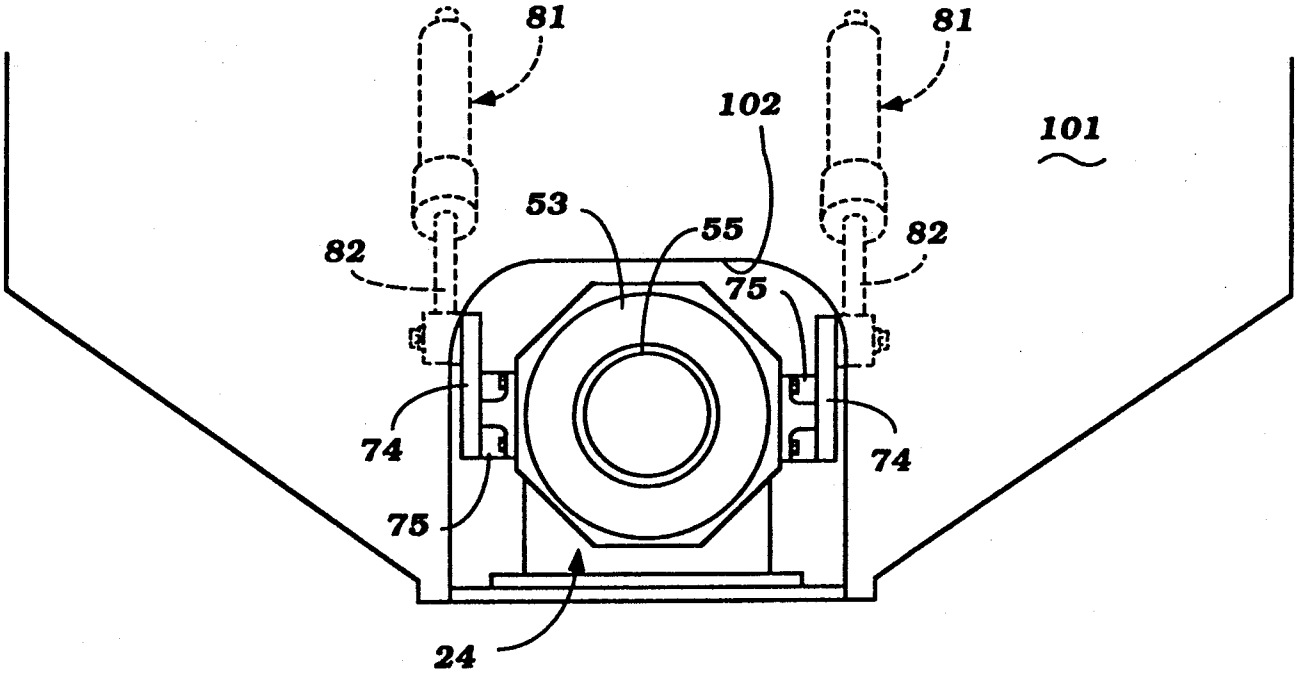
FIG. 3 is a rear elevational view of the watercraft.
Figure 4:
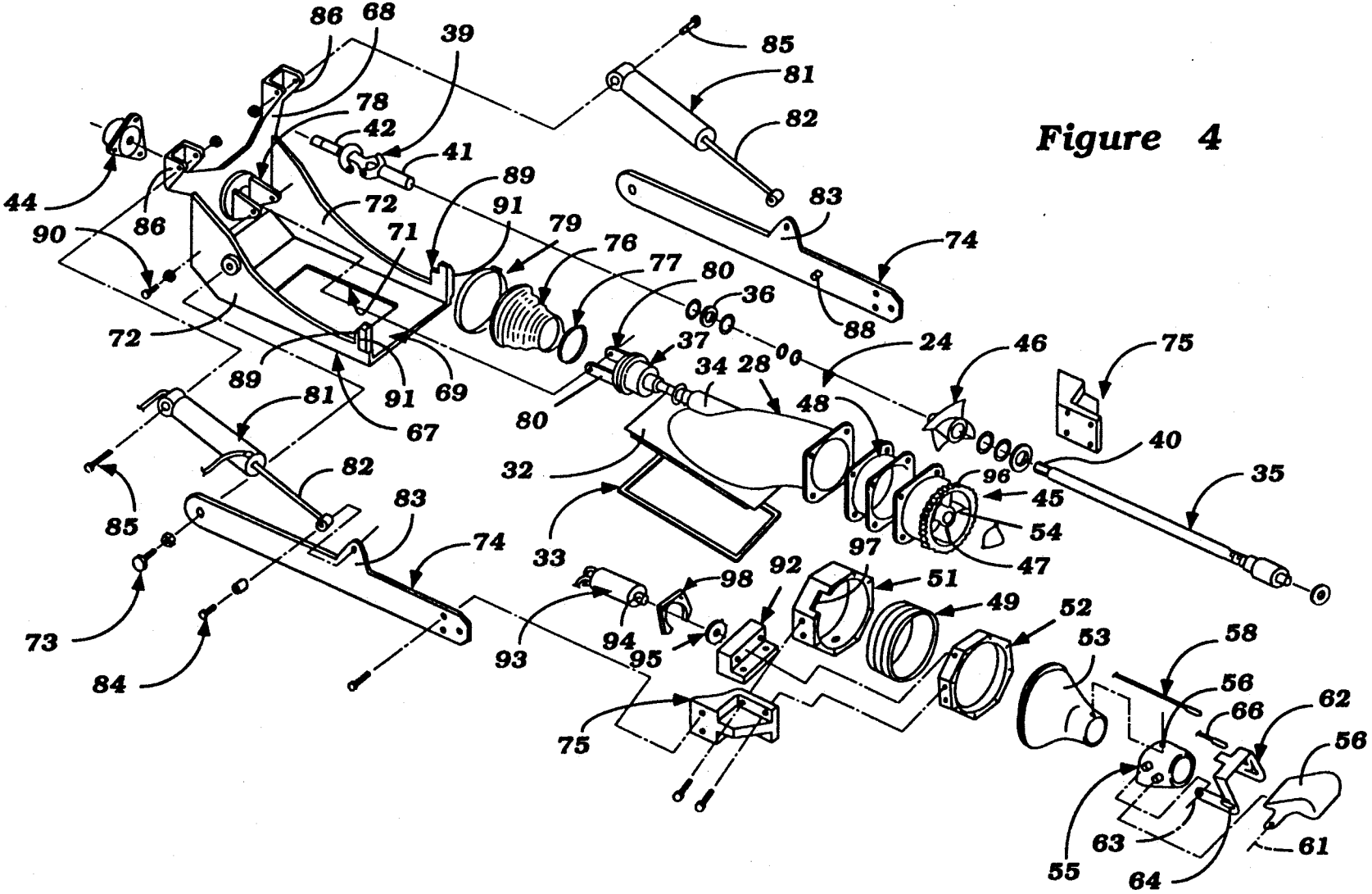
FIG. 4 is an exploded perspective view showing the jet propulsion unit and its mounting arrangement within the watercraft.

Referring now to the remaining figures and initially primarily to FIGS. 2 and 4, the jet propulsion unit 24 includes an outer housing that is comprised of an inlet portion 28 that defines a downwardly facing water inlet opening 29. The inlet opening 29 is defined by a housing flange 32 of the housing portion 28 and which also faces downwardly. The flange 32 has generally rectangular configuration and carries a downwardly facing seal 33, for a purpose to be described.

The water inlet portion 28 has a forwardly extending pilot portion 34 that passes an impeller shaft 35. A seal 36 surrounds the impeller shaft 35 within the portion 34 and provides a water seal to preclude water leakage.

The forward end of the housing portion 34 receives a fitting 37 that carries a seal and bearing 38 for journaling the impeller shaft 35 adjacent the forward end thereof. A universal joint, indicated generally by the reference numeral 39 has a yoke portion 41 that has a splined connection 40 to the impeller shaft 35. The yoke portion 41 is, in turn, connected to a further yoke portion 42 that has a connection to the engine output shaft 21. This connection is contained within a bushing 44 which is mounted in a manner to be described. The aforedescribed connection permits a driving connection between the engine output shaft 21 and the impeller shaft 35 which also permits the jet propulsion unit 24 to be pivoted about a transverse, horizontal axis as defined by the universal joint 39 and a further construction, to be described.

Rearwardly of the inlet portion 28 of the jet propulsion unit outer housing, there is provided an impeller housing, indicated generally by the reference numeral 45 in which an impeller 46 is contained. The impeller 46 is suitably coupled to the impeller shaft 35. The rear end of the impeller shaft 35 is journaled within a bearing assembly 47 that is carried in the impeller housing 45 of the jet propulsion unit housing in a suitable manner. A flange assembly, indicated generally by the reference numeral 48 is provided at the forward portion of the impeller housing 45 for attaching the impeller housing 45 to a corresponding flange of the water inlet portion 28.

The impeller housing 45 is formed with a cylindrical surface that is journaled by means of a bushing 49 within a bearing member 51. The bearing member 51 is, in turn, affixed by means of a coupling plate 52 to a discharge nozzle 53 which also forms a component of the outer housing assembly of the jet propulsion unit 24. The discharge nozzle 53 receives water which has been discharged from the impeller section 45 by the impeller 46 past straightening vanes 54 formed integrally with the impeller housing 45.

A steering nozzle, indicated generally by the reference numeral 55 is supported for steering movement at the discharge end of the discharge nozzle 53 by means of vertically extending pivot pins 56. The steering nozzle 55 has an outwardly extending steering arm (not shown) formed integrally with it to which a bowden wire 58 is affixed by a suitable coupling. The forward end of the bowden wire 58 is connected to the steering wheel 16 in appropriate manner for steering of the watercraft in a manner as is well known with such jet propulsion units.

A reverse thrust bucket 59 has arm portions that are journaled on opposite sides of the steering nozzle 55 by means of pivot pins 61 for movement between a normal forward drive position as shown in solid lines in FIG. 2 and in a reverse thrust position across the end of the discharge nozzle 53 for generating a reverse thrust when desired. An actuating lever 62 is also pivoted on the steering nozzle 55 by means of pivot pins 63 and has a cam slot 64 that receives pins of the reverse thrust bucket 59. An operating bowden wire 66 is connected to the actuating lever 62 and is operative when pulled to pivot the actuating lever 62 and move the reverse thrust bucket 59 between its forward and reverse positions. The forward end of the bowden wire 66 is connected to an appropriate control positioned in the passenger compartment 15 which control does not appear in the figures.

The construction by which the jet propulsion unit 24 is mounted within the tunnel 23 will now be described by particular reference to FIGS. 2 through 5. This mounting arrangement includes a cradle assembly, indicated generally by the reference numeral 67 which is affixed in a suitable manner to the rear side of the bulkhead 22 and to which bushing 44 is affixed. The cradle assembly 67, has a generally vertically extending wall 68 that is positioned in confronting relationship to the rear side of the bulkhead 22 and a horizontally extending portion 69 in which an opening 71 is formed which opening registered with the inlet opening 29 of the jet propulsion unit housing portion 28. The seal 33 as aforedescribed is normally in sealingly engagement with the horizontally extending portion 69 around the opening 71 so as to provide against water and air leakage in this area while permitting unrestricted flow to the water inlet opening 29 and, in fact, may be carried by the portion 67.

The cradle assembly 67 also has a pair of vertically extending side walls 72 that are integrally connected with the front wall 68 and the bottom wall 69 so as to offer reinforcing. In addition, the side walls 72 receive readily removable pivot pins 73 that are aligned with the universal joint 39, for a reason to be described, and which pivotally journal a pair of spaced apart support arms 74 at their forward ends. The support arms 74 are, in turn, affixed at their rear ends to mounting brackets 75 which brackets are affixed by threaded fasteners to the support arm 74 and to the bearing member 51. As a result of this construction, the jet propulsion unit 24 will be pivotally supported by the cradle assembly 67 about the pivot axis defined by the pivot pins 73.

This pivotally movement is accommodated by the universal joint 39 as aforedescribed. The universal joint 39 is encircled and sealed by means of a flexible boot 76 that is secured to the fitting 37 by means of a clamp 77 and secured to an extending portion 78 of the mounting cradle assembly 67 by means of a clamp 79 so as to provide good water tight sealing for the universal joint 39 while permitting its free rotation and free pivotal movement.

The fitting 37 has a pair of forwardly extending arms 80 that are pivotally connected to a pair of extending arms of the portion 78 of the cradle 72 by means of pivot bolts 90 so as to further provide pivotally support for the jet propulsion unit 24 relative to the cradle assembly 67.

The pivotal movement of the jet propulsion unit 24 about the horizontally disposed transverse axis defined by the pivot bolts 73 and 90 permits movement of the jet propulsion unit 24 from its normal operative position as shown in FIG. 2 to an elevated position as shown in FIG. 4 and the phantom line view of FIG. 2. This permits the water inlet 29 to be raised out of the body of water in which the watercraft is operating above the normal water level 27 so as to preclude the likelihood of incrustation occurring on the water inlet portion 29.

A power operated device is incorporated so as to pivot the jet propulsion unit 24 about the aforedescribed horizontally extending transverse axis. This power device includes a pair of hydraulicly operated cylinders 81 that have piston rods 82 connected to an extending portion 83 of the supporting arms 74 by means of readily removable pivot pins 84. The cylinders of the units 81 are pivotally connected, by means of pivot bolts 85 to mounting portions 86 formed integrally with the cradle assembly 67 at the upper end of its vertically extending portion 68 on opposite sides thereof. In order to supply fluid under pressure to actuate the fluid cylinders 81, there is provided an electrically driven reversible pump and valve assembly, indicated generally by the reference numeral 87, that is mounted on the forward side of the bulkhead 22 (FIGS. 2 and 5) and which is controlled by a suitable remotely positioned controller (not shown).

It should be readily apparent that there are substantial side thrusts generated on the jet propulsion unit 24 when in its operating position and particularly when the steering nozzle 55 is pivoted. The support arms 74 and their rigid connection to the bearing member 51 through the mounting bracket 75 insures a rigid assembly that will take these side thrusts. In addition, the support arms 74 have inwardly extending pin portions which are received in complementary recesses 89 formed in upstanding portions 91 of the cradle assembly 67 when the jet propulsion unit 24 is in its normal operative position so as to insure a rigid assembly with minimum likelihood of movement under these forces. In addition and unlike prior art constructions, no pin and slot arrangement is required for controlling the pivotally movement of the jet propulsion unit 24 and, accordingly, an extremely rigid, noise free and strong construction will result.

It should be readily apparent that the pivotal movement of the jet propulsion unit 24 between its normal operative position and its raised out of the water position can be accommodated by flexure of the wire actuators 58 and 66. Their protective sheaths are affixed by means of a fastener or retainer to the mounting bracket 75 at one side of the jet propulsion unit 24 so as to insure against kinking of the transmitters.

In addition to the pivotal movement about the transversely extending horizontal axis, the jet propulsion unit 24 is constructed so that the water inlet portion 28 may be rotated between a downwardly facing position as shown in the figures and an upwardly facing position. This brings the water inlet opening 29 in registry with the access opening 26 so that any entrapped foreign material may easily be removed without necessitating removal of the watercraft 11 from the body of water in which the watercraft is operating. It is not necessary to rotate the entire jet propulsion unit 24 but only the water inlet portion 28 thereof. The structure for accomplishing this result is best shown in FIGS. 2 through 5.

It has been previously noted that the impeller housing 45 is mounted within the bearing member 51 for rotation by the bushing 49 and that the impeller housing 45 is affixed to the water inlet portion 28. The bearing member 51 also has mounted to it, by means of a supporting bracket 92, an electric drive motor 93. The electric drive motor 93 has a driven shaft 94 to which is affixed a drive gear 95. The drive gear 95 is enmeshed with a driven ring gear 96 which is formed integrally with the impeller housing 45. This drive gear 95 extends through a notch 97 formed in the bearing member 51 and is enclosed by means of a cover plate 98 so as to provide a driving arrangement between the drive gear 95 and the driven ring gear 96. When the motor 93 is energized, the ring gear 96 will be rotated along with the impeller housing 45 and water inlet portion 28 from a downwardly facing position, as aforenoted, to the upwardly facing service position. When in this position, servicing can be possible by permitting clearing of foreign material from the water inlet 29. However, since the discharge nozzle 53 and steering nozzle 55 do not rotate, there is no problem with damaging the wire transmitters 58 or 66 or for accommodating such rotary motion at was necessary with the prior art constructions.

Figure 5:
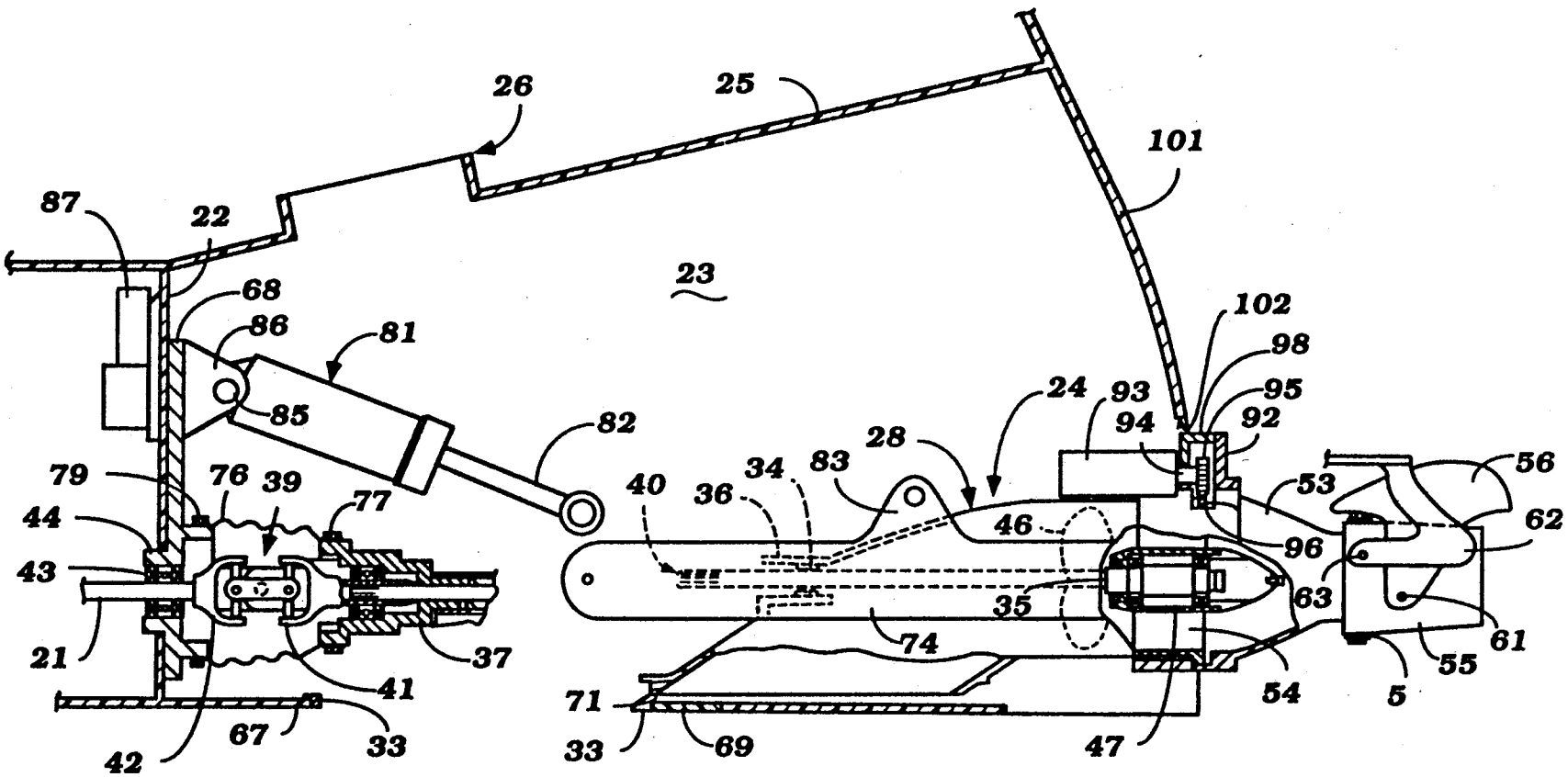
FIG. 5 is a cross-sectional view, in part similar to FIG. 2, showing how the jet propulsion unit may be removed from the watercraft.

In prior art constructions, the tunnel 23 has been open through the rear or transom of the watercraft which transom is indicated generally by the reference numeral 101. The reason for this is to permit access to the jet propulsion unit 24 for its removal and installation. However, in accordance with the invention, the transom 101 is provided in the illustrated embodiment with only a small cutout or notch 102 formed at its extreme lower edge. This notch or cutout 102 provides a relatively narrow opening through which the jet propulsion unit 24 may be easily removed as shown in FIG. 5. This removal is made possible by the removal of the pivot pins 73 at the forward ends of the support arm 74 and the pivot pins 84 that connect the piston rods 82 to the support arms 74. When these pivot pins are removed, the support arm 74 will swing downwardly and the unit can be readily removed through the small opening 102. When the jet propulsion unit 24 is pulled rearwardly, the spline connection 40 between the impeller shaft 35 and the yolk 41 will be easily slipped apart. As a result, it is possible to provide a substantially closed transom which is only opened through the small opening 102 and hence, the watercraft hull will be extremely rigid.

From the foregoing description it will be readily apparent that the jet propulsion unit 24 may be easily removed if desired for servicing of the major components thereof without necessitating a large hole in the transom of the watercraft. Of course, the described construction is that of a preferred embodiment of the invention and various changes and modifications may be made without departing from the spirit and scope of the invention, as defined by the appended claims.

We claim:

1. A water jet propelled boat comprised of a hull defining a tunnel at the rear under side thereof, said tunnel being defined between a pair of side walls and a top wall, a jet propulsion unit mounted within said tunnel for propelling said boat, the transom of said hull having a portion extending in a fixed position between said side and top walls for substantially closing the rear of said tunnel and defining a relatively small fixed opening at the lower portion thereof through which the jet propulsion unit may be removed from within said hull so as to provide a relatively rigid transom of the jet propelled boat.

2. A water jet propelled boat as set forth in claim 1 further comprising a pair of spaced apart support arms having a readily removable pivotal connection to the hull, said jet propulsion unit having a housing assembly comprised of a water inlet portion, an impeller portion containing an impeller for drawing water through said water inlet portion from the body of water in which said boat is operating and a discharge nozzle for discharging water from said impeller portion for propelling said boat, and means connecting said support arms to said jet propulsion unit housing assembly for pivotal movement of said jet propulsion unit relative to said hull upon pivotal movement of said support arms.

3. A water jet propelled boat as set forth in claim 2 further including a power source supported within the hull for driving the impeller.

4. A water jet propelled boat as set forth in claim 3 wherein the power source comprises an internal combustion engine having an output shaft connected by means of a universal joint and a spline connection to the impeller for removal of the jet propulsion unit from the boat.

5. A water jet propelled boat as set forth in claim 4 wherein the universal joint lies on the pivot axis.

6. A water jet propelled boat as set forth in claim 1 further including means for detachably mounting the jet propulsion unit within the hull for its removable through the relatively small fixed opening.

7. A water jet propelled boat comprised of a hull defining a tunnel at the rear under side thereof, said tunnel being defined between a pair of side walls and a top wall, a jet propulsion unit mounted within said tunnel for propelling said boat, the transom of said hull having a portion extending between said side and top walls for substantially closing the rear of said tunnel and defining a relatively small opening at the lower portion thereof through which the jet propulsion unit may be removed so as to provide a relatively rigid transom of the jet propelled boat, said jet propulsion unit being mounted within said tunnel for movement between a normal operative position for propelling the boat and a raised position for raising the water inlet opening of the jet propulsion unit to an out of the water position, the top wall of said hull defining said tunnel being sufficiently high so as to permit said jet propulsion unit to be moved between said positions while substantially within said tunnel, the upper end of said relatively small opening lying substantially below the rear end of said top wall.

8. A water jet propelled boat as set forth in claim 7 wherein the hull has an access opening formed in the tunnel through which the water inlet portion may be accessed when in its out of the water position.

9. A water jet propelled boat as set forth in claim 8 further including means for supporting the water inlet portion of said jet propulsion unit for rotation about a longitudinally extending rotational axis.

10. A water jet propelled boat as set forth in claim 9 wherein the jet propulsion unit is pivotally movement about an axis that extend transversely and horizontally relative to the hull.

11. A water jet propelled boat as set forth in claim 10 further including a power source supported within the hull for driving the impeller.

12. A water jet propelled boat as set forth in claim 11 wherein the power source comprises an internal combustion engine having an output shaft connected by means of a universal joint to the impeller.

13. A water jet propelled boat as set forth in claim 12 wherein the universal joint lies on the transverse horizontal axis.

* * * * *